United States Patent [19]

Molnar

[11] 3,994,134

[45] Nov. 30, 1976

[54] APPARATUS FOR POWER GENERATION IN DEEP SEAWATER

[75] Inventor: Steven I. Molnar, Flushing, N.Y.

[73] Assignee: Cooper Union Research Foundation, Inc., New York, N.Y.

[22] Filed: July 10, 1975

[21] Appl. No.: 594,811

Related U.S. Application Data

[63] Continuation-in-part of Ser. No. 462,119, April 18, 1974, abandoned.

[52] U.S. Cl. ..... 60/496; 290/53

[51] Int. Cl.[2] ..... F03B 13/10; F03B 15/04

[58] Field of Search ..... 60/495, 496, 398; 290/53; 417/329

[56] References Cited

UNITED STATES PATENTS

| | | | |
|---|---|---|---|
| 1,550,408 | 8/1925 | Witt | 60/496 |
| 2,106,264 | 1/1938 | Anastasakis | 417/329 |
| 2,652,690 | 9/1953 | Labriola et al. | 60/398 X |
| 3,504,648 | 4/1970 | Kriedt | 60/398 X |

*Primary Examiner*—William L. Freeh

[57] ABSTRACT

The apparatus is operating in deep seawater, creating there a space of normal pressure and utilizing the arising pressure difference. The device consists of a telescope-like moving pumping equipment, furthermore an angularly built border frame, a prime mover, a locomotion equipment with motor, a counterbalancing system and a power generator.

7 Claims, 4 Drawing Figures

FIG. 1
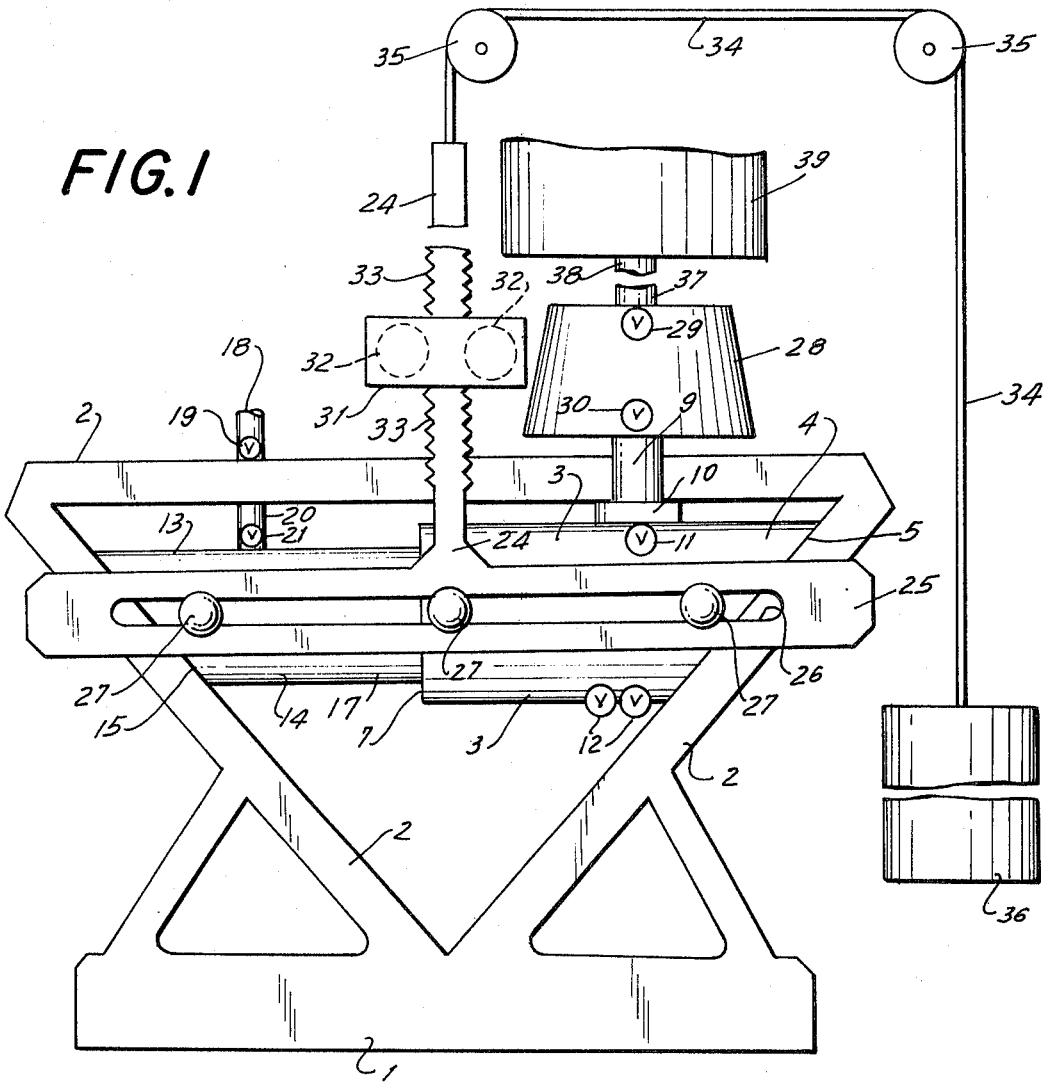
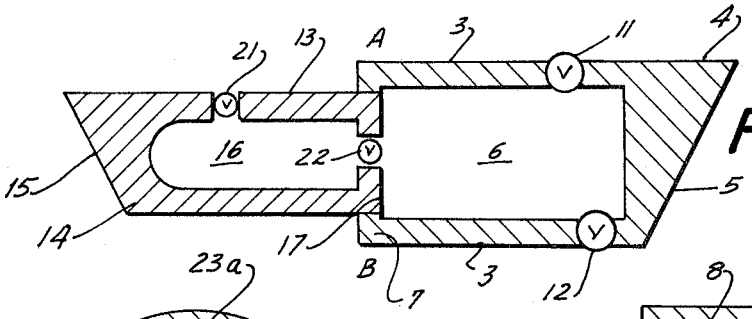
FIG. 2
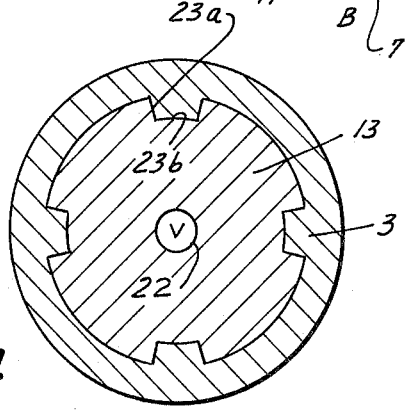
FIG. 4
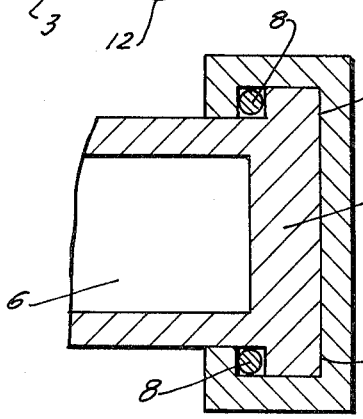
FIG. 3

APPARATUS FOR POWER GENERATION IN DEEP SEAWATER

CROSS-REFERENCES

This application is continuation-in-part of Ser. No. 462,119 filed on Apr. 18, 1974, now abandoned.

BACKGROUND

This disclosure is directed to an equipment which is particularly constructed to produce electric energy from the high pressure energy of the deep seawater of which pressure increases by a half pound per square inch for 1 foot of depth or by 1 atmosphere per square foot for 33 feet of depth. The U.S. Navy's submarine record is 35,800 feet of depth.

Everacting, constant gravity forces serve as a basis for the operation of the apparatus. It takes place with the aid and intermediateness of the surrounding seawater masses, in the midst of the practically borderless, incompressible but still yielding and rebounding ocean water. The ocean is saturated with practically limitless, powerful energy. The pressing forces of the seawater are in equilibrium, unless this state is upset by the nature or by mechanical forces. In the following description of this invention it will be illustrated that in the deep seawater, in the interior of a special pumping equipment it is possible to create periodically a wide space of normal pressure with the aid of the separating effect of a wedgelike frame. Then a prime mover is interposed between said vacated space and the powerful seawater and the high pressure difference is permitted to act periodically on the prime mover that produces from potential energy kinetic energy, convertible into electricity. It will be shown, that only a fraction of the produced power is used for the operation of the apparatus, the bulk of the energy is available for consumption. The device is capable of supplying the required energy in incremental amounts, as may be required.

A logical necessity is that after performance the used seawater is to be discharged smoothly and easily into the sea; the suggested device accomplishes this task by insignificantly little effort which represents a very small quantity of the produced electric energy.

During the procedure the volume of the pumping equipment increases. Apparently, the ocean tolerates said occurence. The flexibly cohesive molecules of the seawater are ready to give way to the waves caused by said expansion of the pumping equipment. In other words, the ocean yields to relatively diminutive volume increase, no significant curbing effect occurs.

Pulling effect of the gravity on the pumping equipment is counterbalanced by employment of a counterweight system. In this manner, solely the difference, if any, between two different gravity forces and resistance of frictions have to be overcome.

Location of the suggested apparatus on the seabottom is unprecedented, moreover chemical and physical conditions around the aimed location are not well known. Therefore, selection of sea depth for most advantageous operation, protection against seadust, water filtration, coverage of parts as well as lifting and cleaning systems are of importance.

Manufacturing of the apparatus is easy since only the border frame with its pumping equipment have novel but simple construction, other components are conventional.

SUMMARY

The suggested apparatus consists of: a pumping equipment within an angular border frame; a locomotion equipment with motor and counterbalancing system; a prime mover and a power generator.

The assemblage is placed on the seabottom; especially the pumping and locomotion equipments are in vertical position.

Above the anchored base an angularly formed frame encompasses a reciprocating water receiving receptacle and a congruent plunger. The receptacle with its water receiving chamber and the plunger compose a special pumping equipment that slides with its outer ends along the sidewalls of the angular frame, carrying out thereby diverging-converging as well as upward and downward movements, resulting in reciprocal and at the same time in telescopelike operation. While moving divergingly upward and apart, the receptacle and plunger create an empty space in the interior of the receptacle. Arriving to its upper filling position, the empty receptacle chamber is tightly connected and communicates with the prime mover, through opened valves. Forced to act by the admitted powerful seawater, the prime mover accomplishes its performance that ends when the receptacle is filled up with water. During upward movent the receptacle chamber is filled with air from the sea-surface through the connected plunger pocket avoiding thereby a vacuum. Moving convergingly downward, the plunger expels the water from the receptacle chamber into the sea. Valves act accordingly. Said cyclical movements repeat. Complementally employed and working twin pumping equipments or accumulated electric energy secure continuous operation of the apparatus.

It is an important circumstance that the outer ends of the receptacle and plunger are slidingly embedded and sheltered in the rails of said angular border frame. Consequently, the horizontal seapressure is not able to reach and exert effect upon the outer ends of the receptacle and plunger; they move without interference of the horizontal seawater pressures, their longitudinal expansion is not blocked. Vertical movements of the receptacle and plunger are neither hindered by the seapressure since on their lateral walls and outer ends equal vertical pressure forces act opposingly, thereby paralyzing each other.

When the volume of the pumping equipment increases, the volume of the ocean has to expand also by one receptacle chamber volume. However, this volume increase is not opposed significantly by seawater reactions, as it was above elaborated. In addition, it is noted that occurrences in this respect are similar to occurrences around a large object submerged into a lake or sea. The water does not reject the object. Furthermore, a rather theoretical volume increase of the sea occurs only once, corresponding to the volume of the receptacle interior. Following, the volume of the ocean decreases again since the full empty interior of the receptacle receives a seawater portion coming from the prime mover after accomplishing work on it. Thus, no continuous additional increase of the sea volume is caused by the operation of said pumping equipment.

The arrangement of the apparatus is such, that it can utilize the energy of the high sea pressure for power generation in a simple manner and it uses only seaenergy for itself, which energy quantity is only a fraction of the gained total energy.

Other features and advantages will become more readily apparent when considered in view of the drawings and specifications.

DRAWINGS

FIG. 1 illustrates an elevated view of the apparatus with its receptacle and plunger in filling position.

FIG. 2 is a longitudinal cross section of the receptacle with water receiving chamber and the plunger with pocket.

FIG. 3 is an enlarged fragmentary cross sectional view of a border plate and a receptacle portion.

FIG. 4 is a cross sectional view of the receptacle and plunger at their inner ends, in FIG. 2 on line A – B Referring to the drawings, there is shown in FIG. 1 an embodiment of the apparatus constructed in accordance with this invention.

The apparatus with its anchored base 1 is placed on the sea-bottom perferably in a vertical position, that makes possible for the counterbalancing system 34,35,36 to operate unhindered. For simplicity, the main components are shown on top of each other, however they could be also in parallel aligned position.

The generator, valves, motor and sensitive parts of the locomotion system are to be placed in sealed housings.

A receptacle 3 enclosing a water receiving chamber 6 furthermore a plunger 13 enclosing a pocket 16 are located opposingly and slidingly in alignment within angularly positioned border plates 2. The receptacle 3 and plunger 13 are built in congruity, the plunger 13 can occupy entirely the chamber 6 of the receptacle 3. To provide stable movement of the plunger 13 in the receptacle chamber 6, the chamber has longitudinal flanges 23*a*, the plunger 13 comprises corresponding grooves 23*b*. The receptacle and plunger casings 3,13 are obliquely cut away at their outer endmost sections 4,14 corresponding to the surface of the angular border frame plates 2 in order to secure sealed and smooth sliding for the outer end surfaces of said casings 5,15. To promote smooth sliding, besides the employed ball bearings 8, any other convenient known tools might be employed.

The receptacle 3 has a valve 11 in its upper wall and the housing of the prime mover 28 has a valve 30 on its lower surface and the housing continues downward in a water conduit 9. In its upper position the receptacle 3 is periodically tightly pressed to the prime mover's 28 water conduit 9 by the locomotion arrangement. In order to secure this junction, any suitable known implement, for instance a bayonet-lock system 10 is positioned in the lower end of the water conduit 9 and it is in electrical way operatively connected to the upper valve 11 of the receptacle 3 and to the lower valve 30 of the prime mover 28. In this manner, periodically open communication is created between the inlet valve 11 and the outlet valve 30 through the water conduit 9 corresponding to the desired flow of the seawater. On its lower surface the receptacle 3 has an outlet valve system 12 of high and quick delivery capacity, preferably consisting of a multitude of hydraulic valves, in accordance with the water pressing action of the plunger 13. In the body of the plunger 13 a pocket 16 is formed to accomodate mildly compressed air portions arriving from the sea surface through pipes 18 and 20 controlled by valves 19 and 21 respectively; furthermore a valve 22 secures communication with the receptacle chamber 6.

The water flow controlling valves 29,30,11 and 12 are preferably of turning valve types. In that case on their axle an electromagnet motor is mounted. When current flows through the armatures they are forced to make a partial turn to open and close thereby the controlled apertures. The air pressure controlling valves 19,21, and 22 are of conventional solenoid types. All valves are periodically opened and closed by electrical current, supplied in the first place by the generator 39 of the apparatus and temporarily from batteries or from the sea surface.

A conventional motor 31 is positioned above or below the inner ends 7,17, of the receptacle 3 and plunger casings 13. The housing of said motor housing 31 comprises in its interior two geared wheels 32 turning simultaneously but in opposite directions (shown in broken lines). Between them a toothed rod 33 is employed in meshing relationship. By activating said two geared wheels 32 in two different directions, the rod 33 is forced to make protracted and retracted on reciprocal movements. The downward continuation of the toothed rod 33 is a push rod 24 and a push frame 25. On both longitudinal sides of the receptacle 3 and plunger 13 a multiplicity of handles 27 are fixed which are longitudinally sliding in the circumscribing slot 26 of the push frame 25. Consequently the pumping equipment 3,13 is forced to move upward or downward and at the same time apart or together respectively. It is noted, that any other similar convenient means are employable for said locomotion and linkage.

Through a suspension cable 34 and pulleys 35 a counterweight 36 is interconnected to the upper end of the push-rod 24,33 which extends from the electric motor 31.

A suitable prime mover 28 operates above the corresponding opening 11 of the water receiving chamber 6. A valve arrangement 30 is interposed, permitting quick and sufficient flow of seawater. The prime mover 28 is preferably a simple hydraulic turbine. When the high pressure ocean water runs through its runners or the like the turbine is put in motion resulting in torque of the turbine shaft 37, which is built in one piece or in geared connection with the shaft 38 of the generator 39. In order to provide continuous and uniform power production, one prime mover 28 might be coupled with two or more identical parallel pumping equipments which operate alternately in adequate combination.

Adjacent to the prime mover 28 a conventional power generator 39 is located, which provides electricity not only for consumption, but also for working parts of the assemblage and besides them for lifting, underwater television, cleaning and similar purposes. The torque of the prime mover shaft 37 is transferred in suitable manner to the power generator 39 which also rotates, when its coil cuts the lines of field poles, electric motive force is induced in it.

Cables lead to the sea surface transferring produced electricity. Pipes secure communication and supply to and from the sea surface.

In operation, in filling position the valves 11,19,21 of the receptacle 3 and plunger 13 are open and are in tight contact by conduit 9 with the prime mover aperture 30 and with the compressed air duct 18,20 and valve 12 is closed. Running through the prime mover's opened inlet valve 29 and through the prime mover 28, the seawater drives the rotating prime mover element and the water receiving chamber 6 is filled up with the used water portion. The water entering chamber 6 forces the air from chamber 6 into space 16 so that the plunger pocket 16 becomes filled up with air, after which time valve 22 closes. When both spaces 6,16 are filled, the upper valves 11,19,21,29,30 close, then the lower valve 12 of the receptacle 3 opens.

When the motor 31 actuates the push-rod 24 and push-frame 25, the receptacle 3 and plunger 13 move downward keeping their aligned relation and with their sheltered outer ends 4,14 are sliding in and along the grooves of the angular border frame 2. This motion downward results in converging, telescopelike movement. In doing so, the plunger 13 gradually enters the water receiving chamber 6 of the receptacle 3 and expels the water into the sea. When the receptacle chamber 6 is entirely evacuated, its outlet valve 12 closes.

It is apparent, that accomplishment of the converging downward phase of the pumping equipment does not require a large quantity of energy. No oppossing sea-pressure prevails, since when the lower valve 12 of the receptacle 3 opens, the water contents of the chamber 6 is exposed to the same pressure as the surrounding seawater. At this moment said seawater portion might be considered being already in the sea. Consequently, said water portion can be forced, without significant effort, to flow from the water receiving chamber 6 to another place in the sea.

At the beginning of the upward movement the valve 22 between the plunger pocket 16 and receptacle chamber 6 opens and the mildly compressed air contents of the plunger pocket 16 is able to expand gradually also into the receptacle chamber 6 in order to avoid occurrence of a vacuum.

During upward movement the receptacle 3 and plunger 13 move telescopelike apart and thereby an empty space is coming into being in the receptacle chamber 6. Horizontal seawater pressures are not able to stop this space-developing procedure, since the outer ends 5,15 of the receptacle 3 and plunger 13 are embedded and sheltered against sea pressures in the grooves of the pressure resisting border frame plates 2.

Thus, horizontal sea pressure forces are blocked up and obstructed in reaching the outer ends of the pumping equipment 3,13 and in striving to press together longitudinally said two casings. Moreover, the opposing vertical sea pressure forces paralyze each other on the side walls of the receptacle 3 and plunger 13. Consequently, the sucking effect of the developing space 6 is entirely separated from the vertical and horizontal sea pressures. Both actions are thereby entirely blocked up in hindering said space-developing procedure.

Co-action of the electrically driven components, as the valves 11,12,19,21,22,29,30 and push-rod 24, occurs in accordance with the aid of conventional electrical control systems or other suitable device, disposed within the receptacle 3, sensing the level of the water and operatively connected through relays and suitable other control means to the motors or the like. When the water level rises or falls to a predetermined level said implements are energized or deenergized by the power sources in order to regulate the locomotion and the water or air flow. To start the operation of the apparatus initial power is supplied from accumulated resources or from the sea surface, following the device is self-supplier. For this purpose used power is only a small fraction of the produced electricity.

The weight of the pumping equipment 3, 13 is counterbalanced by the counter weight system 34,35,36.

While moving upward and apart the receptacle chamber 6 is vacated by the plunger 13. On account of this expansion, the apparent weight of the pumping equipment 3,13 decreases by the weight of the displaced seawater. Thus, the counterweight, becoming heavier than the pumping equipment 3,13 it can move downward evey by itself. This out-of-balance ceases when the empty receptacle chamber 6 is filled up again in its upper position by seawater arriving from the prime mover 28. Therefore, the pumping equipment 3,13 regains its original weight, equaling the counterweight again, until the motor 31 upsets the balance by its push effect regulated by the control system, corresponding to the predetermined water level in the receptacle 3. Starting from equilibrium, comparatively small quantity of energy is required for said forced motions, therefore, the central motor 31 has to overcome mainly the resistance of frictions.

As a consequence of the aforedescribed arrangements and advantageous circumstances, the pumping equipment 3,13 during operation is not required to overcome the powerful pressures of the ocean, it is eluded and repelled, resulting in highly lucrative operation.

In my present application considered to be novel, comprises:

co-acting operation of parts with the aid of electrical motors and control systems;

geared drive of the central motor;

mechanical connection between the prime mover and generator;

accumulator to supply power temporarily;

hermetically sealed housings.

While this invention has been described with reference to particular embodiment thereof, it will be readily appreciated and understood that variations and modifications may be made without departing from the spirit or scope of the invention.

I claim:

1. Apparatus adapted to exploit the effect of seawater at great pressure comprising, a. a prime mover means for converting water pressure into kinetic energy and having a water inlet and a water outlet arranged to be opened and closed simultaneously thereby permitting periodic flow of water under pressure through the prime mover;

b. an elongated casing having a water-receiving chamber therein; a complementary elongated plunger cooperatively associated with said water-receiving chamber; means for mounting said water-receiving chamber and said plunger for movement between a filling position and a discharge position, said water-receiving chamber having a water inlet and a water outlet; said water inlet being disposed in open communication with the prime mover means when the water-receiving chamber is in the filling position whereby water may be introduced into said chamber, and said water inlet being closed when the water-receiving chamber is in the discharge position, and said water outlet being in open communication with the interior of said chamber when the water-receiving chamber is in the discharge position and closed when the water-receiving chamber is moving toward or is in the filling position; said plunger having a pocket formed therein, said pocket having an inlet valve and an outlet valve, said inlet valve adapted to connect said pocket to a source of air, and said outlet valve adapted to place said pocket in communication with said water-receiving chamber;

c. means mounting said casing and plunger for movement along converging transverse paths between said filling position and said discharge position and along diverging transverse paths between said discharge position and said filling position; and d. drive means operatively connected to said plunger and said casing for effecting movement thereof between said filling position and said discharge position.

2. The invention as defined in claim 1, wherein said means (c) is provided by oppositely disposed plates inclined relative to one another to define a converging-diverging path and means on said plates for guiding said casing and plunger during the reciprocal movement between said filling position and said discharge position.

3. The invention as defined in claim 1 and including counterbalanced lifting means for facilitating the movement of said casing and plunger.

4. The invention as defined in claim 3 and including power producing generator mechanically interconnected to said prime mover.

5. The invention as defined in claim 1 and including an additional, identical pumping mechanism forced to slide on a second converging-diverging path accomplishing alternate, complementary pumping action, securing thereby continuous operation for said apparatus.

6. The invention as defined in claim 5 and including counterbalanced lifting means for facilitating the movement of said casings and plungers.

7. The invention as defined in claim 6 and including power producing generator mechanically interconnected to said prime mover.

* * * * *